United States Patent [19]

Pribbenow

[11] 4,416,554

[45] Nov. 22, 1983

[54] THRUST BEARING FOR ROCK BITS

[75] Inventor: Walter A. Pribbenow, Ponca City, Okla.

[73] Assignee: Smith International, Inc., Newport Beach, Calif.

[21] Appl. No.: 396,938

[22] Filed: Jul. 9, 1982

[51] Int. Cl.[3] ..... F16L 33/06; E21B 10/22

[52] U.S. Cl. ..... 384/95; 175/372

[58] Field of Search ..... 384/92–96, 384/420, 425, 303; 175/371, 372

[56] References Cited

U.S. PATENT DOCUMENTS 3,995,917 12/1976 Quinlan ..... 384/95
4,136,748 1/1979 Dickerhoff ..... 175/372 X
4,167,220 9/1979 Ernst et al. ..... 384/92 X
4,270,812 6/1981 Thomas ..... 384/95

*Primary Examiner*—Stuart S. Levy
*Assistant Examiner*—David J. Werner
*Attorney, Agent, or Firm*—Robert G. Upton

[57] ABSTRACT

A chamfered intermediate thrust bearing is positioned between a rotating cutter and its bearing pin of an earth-boring rock bit. The chamfered intermediate bearing is so configured to be mechanically secured in place within the cone and to take outthrust loads, without rotation, that are directed axially against a radially disposed surface of the roller cone journal as the rock bit works in a borehole.

3 Claims, 3 Drawing Figures

THRUST BEARING FOR ROCK BITS

CROSS-REFERENCE TO RELATED APPLICATION

This invention relates to a commonly-assigned patent application, entitled THRUST BEARING FOR ROCK BITS, Ser. No. 379,692, filed May 19, 1982.

BACKGROUND OF THE INVENTION

1. Field of the Invention

This invention relates to thrust bearing washers for rotary cone rock bits.

More specifically, this invention relates to a means to prevent rotation and to mechanically lock in place an intermediate thrust bearing washer radially disposed between a roller cone and a journal, the washer being primarily designed to take axial thrust loads.

2. Description of the Prior Art

There are a number of prior art patents that provide some means between rotating cones and their respective journals to take axially directed outthrust loads directed against radial surfaces formed on the journal bearings.

It is within the state of the art to provide a hard metal bearing surface on radially disposed areas of the journal and the cone by either depositing hard metal material to either the end of the journal or within radially disposed surfaces in the cone. The deposited hard metal material is subsequently machined to provide a smooth bearing surface between the journal and the rotating cone.

The problems that emerge utilizing the foregoing techniques are many. For example, when hard metal material is metallurgically deposited either within the cone or on radially disposed surfaces of the journal, the heat generated causes stress risers that can result in cracks, especially in the rotating cones. In addition it is difficult, costly and time-consuming to machine these rough, hard metal deposition surfaces to form good bearing surfaces essential to the proper operation and longevity of the rock bit.

The present invention overcomes this difficulty by simply providing a hard metal, nonrotating locked-in-place disc between the journal and the cone.

U.S. Pat. No. 3,720,274 teaches the use of an intermediate thrust bearing washer freely disposed within radially aligned surfaces formed between the end of a journal bearing and a rotating cone associated therewith. The thrust bearing serves to support thrust loads and stabilizes the cone cutters. The intermediate thrust bearing washer is allowed to float between the pin and the journal. A difficulty with this arrangement is that, as the rock bit wears in an operating mode, the thrust washer begins to gall, causing the bearing to eventually fail.

The previously filed patent application obviates the problem of the floating thrust washer in that a hard metal radial surface is provided in the form of an elliptical washer that is nested within a complementary elliptical cavity formed in the cone so that it will not rotate. The elliptical washer thereby provides a stable thrust bearing surface. Moreover, no additional rotating parts are necessary and problems associated with hard metal deposition methods, i.e., cracking and uneven heat distributions through the cone, are essentially eliminated.

While the elliptical disc or washer and matching recess is a decided improvement over the prior art, the present invention is yet another improvement over the related application as well as known prior art.

The edge of the elliptical disc of the present invention is chamfered. The larger elliptical peripheral edge of the disc is first placed in a complementary elliptical recess formed in the cone. The smaller peripheral edge of the disc defines the bearing surface adjacent the radially disposed bearing surface of the journal. The elliptical recess in the cone is also chamfered to mate with the chamfered surface formed on the peripheral edge of the disc. The disc is first aligned with the elliptical recess or cavity within the cone, dropped into place within the cavity, followed by rotation of the disc within the recess. The major axis of the elliptical disc is now rotated so that it no longer is in parallel alignment with the major axis of the elliptical cavity within the cone. The chamfered edge of the disc now registers with the chamfered surface formed within the cone, thus locking the disc within the cone. The disc or washer will not rotate nor can it become dislodged from its elliptical cavity; a possibility with the previously filed application if enough wear occurs between the rotating cone and its respective journal during operation of a rock bit.

SUMMARY OF THE INVENTION

It is therefore an object of this invention to provide a nonrotating, self-locking thrust washer or disc to take outthrust axial loads between the journal and the associated cone of a rotary rock bit.

More specifically, it is an object of this invention to provide a chamfered elliptical thrust washer or disc that is inserted into a complementary chamfered elliptical recess in a radially disposed surface formed within a rotary cone. The thrust washer then is locked within the rotary cone by limited rotation of the disc within the chamfered recess of the cone, thereby preventing rotation and dislodgment of the thrust washer or disc while providing a hard metal bearing surface between the rotary cone and the radially disposed surface as defined on an associated journal bearing.

A rotary rock bit is disclosed having a bit body with an upper end connectable to a drillstring. At least one bearing journal extends from an opposite end of the body. The bearing defines at least one radially disposed bearing surface thereby. A cutter cone is rotatably positioned on the journal. The cutter cone defines at least one radially disposed bearing surface. The cone bearing surface is so configured to mate with the radially disposed bearing surface formed by the bearing journal. At least one intermediate thrust bearing is positioned between the radially disposed bearing surfaces formed by the journal and the cone. The intermediate bearing is substantially locked between the journal and bearing by intermediate bearing retention means. The bearing retention means prevents rotation and dislodgment of the intermediate thrust bearing when the cone is rotated on the journal.

An advantage then over the prior art is the use of a nonrotating radially disposed thrust bearing between the end of a rock bit journal and its associated cone.

Another advantage over the prior art is the use of a nonrotating hard metal thrust bearing between the journal and the cone without metallurgically bonding the thrust bearing into the cone or the end of the journal of the rock bit.

Still another advantage over the prior art is the elimination of the hard metal deposition process wherein hard metal is deposited within the radially disposed bearing surface in the cone with subsequent machining of the hard metal deposition to form a hard metal bearing surface.

Yet another advantage over the prior art is the mechanical method of locking the nonrotating radially disposed thrust bearing with a rotating cone of a rock bit.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
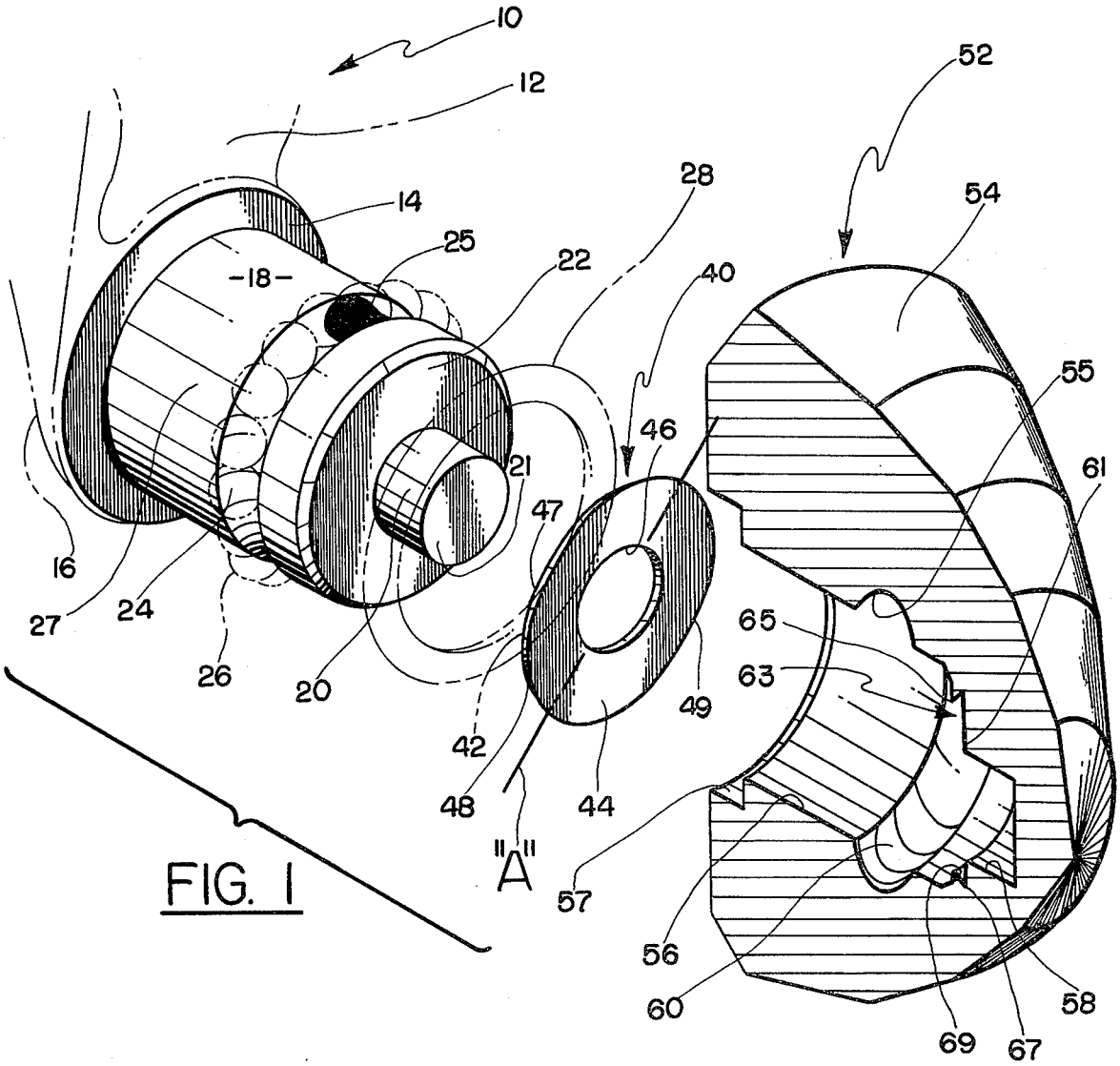
FIG. 1 is a partially cutaway exploded perspective view of the preferred embodiment of the present invention.

Referring now to the perspective exploded view of FIG. 1, a lower portion of a rock bit leg, generally designated as 10, depicts the leg 12, cone backface 14, shirttail 16 and journal 18 cantilevered from the leg 12. Journal 18 defines a cone retention ball track 24 and radially disposed primary thrust surface 22. A spindle bearing 20, of reduced diameter, extends from primary thrust surface 22 and terminates in thrust button 21. A series of, for example, steel balls 26 (shown in phantom line) retain a cone, generally designated as 52, onto journal bearing 18. The balls 26 are inserted after the track 60 in cone 52 registers with the track 24 on journal 18. When the cone is properly positioned on the journal, the balls are inserted through a ballhole in shirttail 16 (not shown). The balls exit through bearing access hole 25, intercepting track 24.

A radially disposed thrust washer, generally designated as 40, defines a first journal bearing surface 42 and a second cone bearing surface 44. The bearing disc further forms a chamfered peripheral surface 48.

Figure 2:
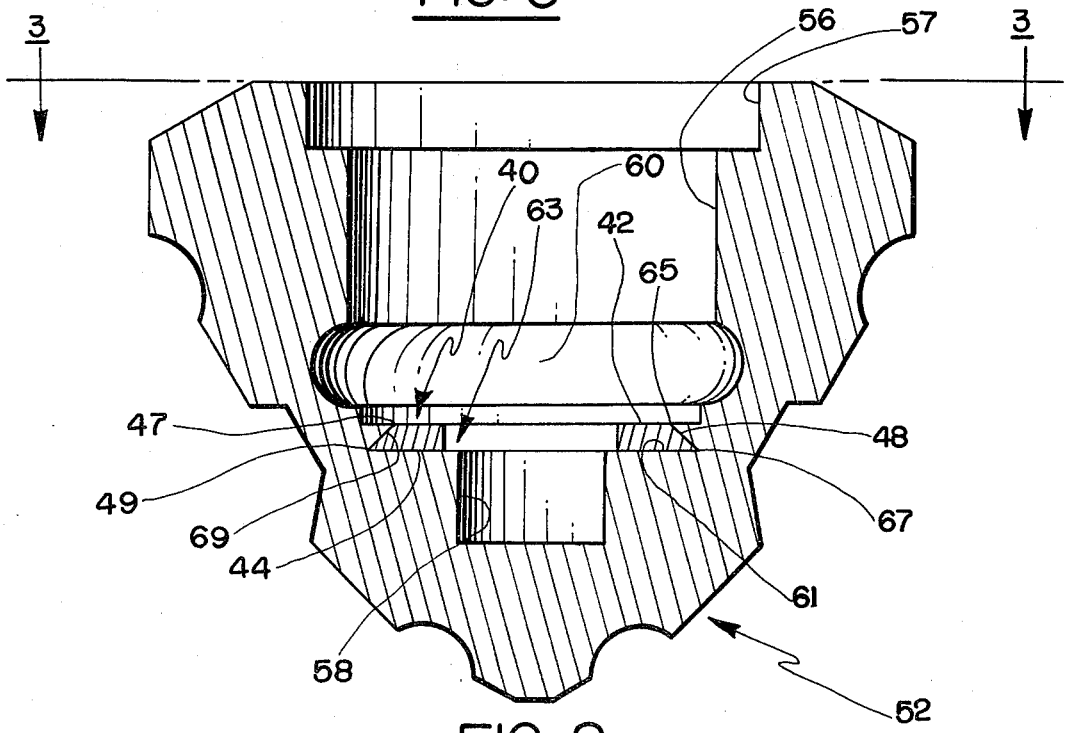
FIG. 2 is a cutaway view of a cone of the rotary cone rock bit.

The bearing washer or disc 40 forms a first elliptically shaped peripheral edge 49 which defines a disc bearing surface 44. The surface contacts a radially disposed cone surface 61 in recess cavity 63 of the cone. Peripheral edge 49 is larger in circumference than a second peripheral edge 47; chamfered surface 48 is formed at an angle with respect to an axis of the journal from the larger circumferential edge 49 to the smaller circumferential edge 47 (FIG. 2). Edge 47 defines a radially disposed bearing surface 42. This surface contacts radially disposed surface 22 on the journal 18 and supports outwardly directed axial loads between the disc 40 and the end of the journal 18.

Figure 3:
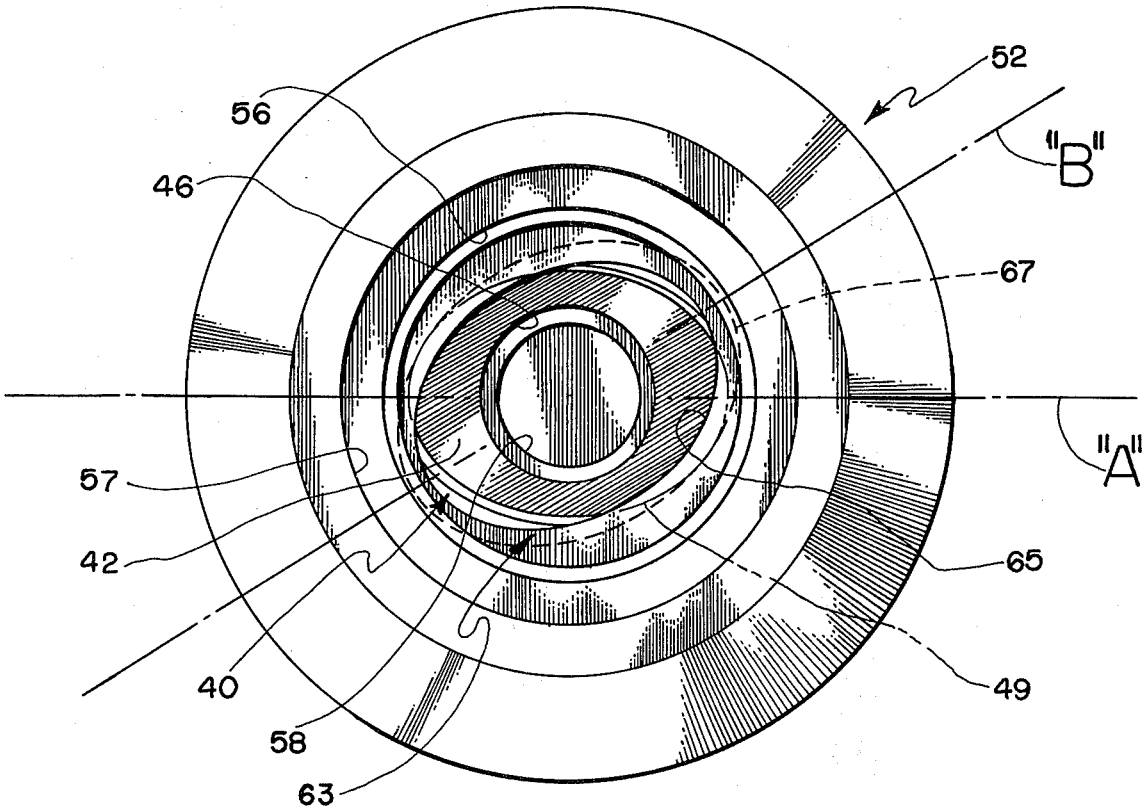
FIG. 3 is a view taken through 3—3 of FIG. 2 illustrating the elliptically shaped thrust bearing mounted or retained within a complementary elliptical retention cavity formed in the cone.

With reference to FIG. 3, cone 52 forms an elliptical cavity 63. A first elliptical entrance opening 65 to cavity 63 is slightly larger than peripheral edge 49 in disc 40. When the elliptical washer or disc 40 is aligned with its major axis "A" parallel to or aligned with the major axis "B" of opening 65, the washer 40 drops within the cavity 63. Face 44 of the disc now nests against face 61 in cone 52. A chamfered surface 69 is formed within the cone, providing an elliptical opening 67 larger than opening 65 in recess cavity 63. The chamfered surface 69 formed in the cone is the same angle as the chamfered surface 48 in disc 40.

To secure disc 40 within the cone 52, the major axis "A" of the disc is aligned with the major axis "B" of the elliptical cavity 63. The washer then is dropped into the cavity and, for example, is rotated clockwise within the cone cavity 63 (FIG. 2). When viewing the cone through the journal opening, the washer 40 then is locked into position against the chamfered surface 69 when rotated as previously described, thus preventing the disc or washer 40 from falling out of cavity 63 within the cone. With reference again to FIG. 3, the disc 40 is shown locked into place within cavity 63 of the cone, the major axis "A" being out of parallel alignment with the major axis "B" of cavity 63. The two chamfered surfaces 48 and 69 contact each other in locking engagement due to rotation of the elliptical disc within its elliptical cavity.

By rotating the disc or washer 40 clockwise in FIG. 3 the disc is firmly locked into place with no possibility of becoming dislodged since the cones, when they contact the borehole bottom, rotate counterclockwise on the journal 18, thus the friction between surface 42 and the primary thrust surface 22 will tend to keep the disc 40 from becoming disengaged from chamfered surface 69 in the cone 52.

It would be obvious however to lock the disc 40 within cavity 63 by rotating the disc counterclockwise without departing from the teaching of this invention.

Cone 52 additionally forms radial load bearing surface 56 and reduced diameter bearing surface 58 to mate with both the journal 18 radial load bearing surface 27 and journal reduced diameter bearing surface 20. A seal gland 57 is formed in the base of cone 52 to accept an O-ring seal 28, seal 28 serving to protect the bearing surfaces during operation of the bit in a borehole.

The intermediate elliptical thrust bearing 40 is preferably fabricated from a hard metal material, such as tungsten carbide, or the bearing could be a composite with a base material of steel having, for example, a hard metal deposition of AMPCO-TRODE 300 aluminum bronze on surface 42 of bearing 40. AMPCO-TRODE is produced by AMPCO METALS, INCORPORATED, Milwaukee, Wis. Another hard metal material suitable for deposition on a steel-based elliptical bearing 40 is HC-1 hardfacing rod, a cobalt-based alloy with major constituents of chromium and tungsten. HC-1 is deposited again on the surface 42, the bearing surface that contacts primary thrust surface 22 of journal 18. HC-1 hardfacing rod can be obtained from STOODY COMPANY, Industry, Calif., and is classified under Code 1477.

The hardfacing material, whether it is AMPCO-TRODE or HC-1, is preferably metallurgically deposited on surface 42 (adjacent primary thrust surface 22), followed by machining and polishing to form a suitable bearing surface. The bearing surface 42 is fabricated from hard metal to take outthrust axial loads subjected to the primary thrust surface 22 of journal 18 during operation of the rock bit. The bearing 40 is again prevented from rotation and locked into position within the cone to prevent galling of the bearing retention cavity 63 and to prevent dislodgment of the elliptical disc from its complementary cavity, thus adding to the longevity of the rock bit as it works in a borehole.

Turning again to FIG. 2, the cross section of the cone 52 clearly shows the relationship of the intermediate elliptical thrust bearing 40 and how it is secured within an identical elliptical cavity 63 in the cone 52.

FIG. 3, looking down into the bearing cavity of the cone, depicts the elliptical retention cavity 63 positioned near the apex of the cone. The intermediate thrust washer or bearing 40 is dropped within this identical elliptical cavity and rotated to engage chamfered surfaces 48 and 69 to mechanically secure the thrust washer in place as previously described. By machining the elliptical cavity 60 in the cones through, for example, a numerically controlled operation, the necessity to hardface the radially disposed bearing surface 61 in the cone 52 is eliminated. By subjecting this area near the apex of the cone to excessive heat during the deposition process of the hard metal, uneven stresses are created, causing cracks in the cone as well as excessive hardness of the cone. In addition, it is very difficult to machine this hard metal surface to provide a smooth bearing surface so that the cone will ride against the primary thrust surface 22 on a journal without excessive friction. Thus a very expensive and time-consuming operation is eliminated by simply machining the chamfered elliptical cavity in a cone to accept the chamfered elliptical intermediate thrust bearing fabricated from a hard metal.

By preventing the intermediate thrust bearing from rotating and from disengaging itself from its cavity in the cone, the same condition is created in the cone that the hard metal deposition process created except better quality control is maintained, thereby providing a more reliable product.

It would be obvious to provide an intermediate thrust bearing for a cone and journal combination wherein the spindle is eliminated. In other words, a flat, chamfered, elliptically shaped intermediate thrust bearing is fabricated, the inner surface of which is adjacent a flat primary thrust surface surface without the spindle (not shown). This configuration, while not shown, would simply position a radially disposed chamfered elliptical journal bearing in a similarly chamfered cavity in the cone, conforming to the same elliptical shape of the thrust bearing. The bit is assembled as heretofore described.

It would also be obvious to provide the elliptical bearing cavity 63 for bearing 40 in the primary thrust surface 22 of journal 18.

In addition, it would be obvious within the teachings of this invention to provide a chamfered peripheral edge 48 other than elliptical. For example, the disc or washer could be shaped in a hexagon, an octagon, etc. (not shown).

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A rotary rock bit comprising:

a bit body having an upper end connectable to a drillstring, at least one bearing journal extending from an opposite end of said body, said bearing journal defining at least one radially disposed bearing surface thereby, a cutter cone rotatably positioned on said journal, said cutter cone defining at least one radially disposed bearing surface, said cone bearing surface being so configured to mate with said at least one radially disposed bearing surface formed by said bearing journal, and at least one radially disposed intermediate thrust bearing positioned between said radially disposed bearing surfaces formed by said journal and said cone, said intermediate bearing is secured between said journal and bearing by intermediate bearing retention means, wherein an outside peripheral surface formed on said intermediate radially disposed thrust bearing is chamfered and noncircular, a first noncircular outside peripheral edge formed on said intermediate thrust bearing nearest a thrust bearing cavity formed in said cone is larger than a second parallel noncircular outside peripheral edge formed on said thrust bearing nearest said radially disposed bearing surfaces formed by said journal, said chamfered surface being formed between said first and second outside peripheral edges formed on said thrust bearing, said chamfered noncircular bearing registers with a matching chamfered noncircular cavity formed in said cone, said first outside peripheral edge of said thrust bearing is smaller than said matching chamfered noncircular cavity formed in said cone, said chamfered thrust bearing is first aligned with said cavity in said cone, said thrust bearing is subsequently placed into registering engagement with said cavity, said thrust bearing being subsequently rotated out of alignment with an opening formed in said cone forming said cavity, said chamfered surfaces formed in said thrust bearing and said cone come in contact with one another to secure said thrust bearing within said cone to prevent dislodgement of said thrust bearing from said matching cavity formed in said cone.

2. The invention as set forth in claim 1 wherein said chamfered noncircular peripheral surface on said thrust bearing and said opening to said chamfered cavity formed in said cone are substantially elliptical in shape.

3. A rotary rock bit comprising:

a bit body having an upper end connectable to a drillstring, at least one bearing journal extending from an opposite end of said body, said journal bearing forming a first portion with a first diameter, a second portion with a second diameter, said second diameter being smaller than said first diameter, a radially disposed journal bearing thrust surface being formed between said first portion and said second portion, a cutter cone rotatably positioned on said journal, at least one intermediate thrust bearing positioned between said radially disposed bearing surfaces formed by said journal and said cone, said radially disposed thrust bearing is a washer, said thrust bearing forming a centrally positioned opening with a diameter larger than said second diameter of said second portion of said journal, said intermediate radially disposed washer thrust bearing is chamfered and noncircular, a first noncircular outside peripheral edge formed on said intermediate thrust bearing nearest a thrust bearing cavity formed in said cone is larger than a second parallel noncircular outside peripheral edge formed on said thrust bearing nearest said radially disposed bearing surfaces formed by said journal, said chamfered surface being formed between said first and second outside peripheral edges formed on said thrust bearing, said chamfered noncircular bearing registers with a matching chamfered noncircular cavity formed in said cone, said first outside peripheral edge on said thrust bearing is smaller than said matching chamfered noncircular cavity formed in said cone, said chamfered thrust bearing is first aligned with said cavity in said cone, said thrust bearing is subsequently placed into registering engagement with said cavity, said thrust bearing being subsequently rotated out of alignment with an opening formed in said cone forming said cavity, said chamfered surfaces formed in said thrust bearing and said cone come in contact with one another to secure said thrust bearing within said cone to prevent dislodgement of said thrust bearing from said matching cavity formed in said cone.

* * * * *